US009278244B2

(12) United States Patent
Chuang et al.

(10) Patent No.: US 9,278,244 B2
(45) Date of Patent: Mar. 8, 2016

(54) FITNESS APPARATUS

(71) Applicants: Jin-Chen Chuang, Taichung (TW); Lung-Fei Chuang, Taichung (TW)

(72) Inventors: Jin-Chen Chuang, Taichung (TW); Lung-Fei Chuang, Taichung (TW)

(73) Assignees: Jin-Chen Chuang, Taichung (TW); Lung-Fei Chuang, Taichung (TW)

( * ) Notice: Subject to any disclaimer, the term of this patent is extended or adjusted under 35 U.S.C. 154(b) by 61 days.

(21) Appl. No.: 14/297,639

(22) Filed: Jun. 6, 2014

(65) Prior Publication Data

US 2014/0364287 A1 Dec. 11, 2014

(30) Foreign Application Priority Data

Jun. 7, 2013 (TW) ..... 102210791 U
Apr. 10, 2014 (TW) ..... 103206240 U

(51) Int. Cl.
*A63B 21/05* (2006.01)
*A63B 21/055* (2006.01)
(Continued)

(52) U.S. Cl.
CPC ..... *A63B 21/055* (2013.01); *A63B 21/00069* (2013.01); *A63B 21/00181* (2013.01);
(Continued)

(58) Field of Classification Search
CPC ..... A63B 21/00003; A63B 21/00007; A63B 21/00018; A63B 21/00032; A63B 21/00069; A63B 21/00072; A63B 21/00087; A63B 21/0009; A63B 21/00094; A63B 21/00109; A63B 21/0012; A63B 21/00123; A63B 21/00127; A63B 21/0013; A63B 21/0083; A63B 21/00178; A63B 21/00181; A63B 21/00185; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/068; A63B 21/08; A63B 21/1446; A63B 21/1457; A63B 21/1461; A63B 21/1465; A63B 21/1476; A63B 21/1488; A63B 21/1492; A63B 21/1496; A63B 21/15; A63B 21/151; A63B 21/154; A63B 21/159; A63B 23/0205; A63B 23/0211; A63B 23/0233; A63B 23/035; A63B 23/03508; A63B 23/03525; A63B 23/03541; A63B 23/0355; A63B 23/04; A63B 23/0405; A63B 23/0482; A63B 23/0494; A63B 23/12; A63B 23/1209; A63B 23/1236; A63B 23/1245; A63B 23/1281; A63B 2208/0214; A63B 2208/0219; A63B 2208/0228; A63B 2208/0233; A63B 2208/0295
USPC ..... 482/905
See application file for complete search history.

(56) References Cited

U.S. PATENT DOCUMENTS 3,428,312 A * 2/1969 Machen ..... A63B 21/04 482/123
3,953,026 A * 4/1976 Stokely ..... A63B 21/023 482/123

(Continued)

FOREIGN PATENT DOCUMENTS

CN 2308404 Y 2/1999
CN 2387900 Y 7/2000

(Continued)

*Primary Examiner* — Oren Ginsberg
*Assistant Examiner* — Gary D Urbiel Goldner
(74) *Attorney, Agent, or Firm* — CKC & Partners Co., Ltd.

(57) ABSTRACT

A fitness apparatus includes a first frame, a second frame, a nose part, a linear elastic element, and a lever. The second frame and the nose part are coaxially and pivotally connected to the first frame. The nose part is swingly connected to the second frame. The lever drives the linear elastic element. The linear elastic element is extendedly bounced and blocked on the first frame. When the second frame pivotally swings against the first frame, the movable range of the linear elastic element will be constrained by the lever because of its high stiffness. In addition, the linear elastic element can stably bounce instead of hitting the inner wall of the first frame. Therefore, the fitness apparatus using the lever can prevent the linear elastic element from sounds of hitting and attrition, so as to achieve the purpose of low noise and increasing the life time of components.

10 Claims, 6 Drawing Sheets

(51) Int. Cl.

| | |
|---|---|
| ***A63B 21/02*** | (2006.01) |
| ***A63B 23/02*** | (2006.01) |
| ***A63B 23/12*** | (2006.01) |
| ***A63B 21/04*** | (2006.01) |
| *A63B 21/008* | (2006.01) |
| *A63B 21/00* | (2006.01) |
| *A63B 22/00* | (2006.01) |
| *A63B 23/035* | (2006.01) |
| *A63B 23/04* | (2006.01) |
| *A63B 71/02* | (2006.01) |

(52) U.S. Cl.

CPC ..... *A63B21/023* (2013.01); *A63B 21/0428* (2013.01); *A63B 21/4047* (2015.10); *A63B 23/0233* (2013.01); *A63B 23/0355* (2013.01); *A63B 23/1236* (2013.01); *A63B 21/0083* (2013.01); *A63B 21/05* (2013.01); *A63B 21/0552* (2013.01); *A63B 21/154* (2013.01); *A63B 22/0056* (2013.01); *A63B 23/03508* (2013.01); *A63B 23/03525* (2013.01); *A63B 23/03541* (2013.01); *A63B 23/0405* (2013.01); *A63B 2071/027* (2013.01)

(56) References Cited

U.S. PATENT DOCUMENTS

| | | | | | |
|---|---|---|---|---|---|
| 4,603,857 | A * | 8/1986 | Chipman | A63B 21/00072 | 482/123 |
| 4,796,881 | A * | 1/1989 | Watterson | A63B 21/023 | 482/130 |
| 4,830,365 | A * | 5/1989 | March | A63B 21/04 | 482/129 |
| 4,844,448 | A * | 7/1989 | Niznik | A63B 21/04 | 482/129 |
| 4,863,162 | A * | 9/1989 | Neckamm | A63B 21/05 | 482/128 |
| 5,184,994 | A * | 2/1993 | Morris | A63B 21/023 | 482/121 |
| 5,338,277 | A * | 8/1994 | Yang | A63B 21/055 | 482/130 |
| 5,419,750 | A * | 5/1995 | Steinmetz | A63B 23/0211 | 482/111 |
| 5,441,473 | A * | 8/1995 | Safani | A63B 23/0233 | 482/130 |
| 5,480,368 | A * | 1/1996 | Huang | A63B 21/157 | 482/123 |
| 5,595,558 | A * | 1/1997 | Moon | A63B 22/0076 | 472/95 |
| 5,613,927 | A * | 3/1997 | Rothacker | A63B 21/28 | 482/123 |
| 5,746,688 | A * | 5/1998 | Prager | A63B 23/03533 | 482/130 |
| 5,752,901 | A | 5/1998 | Lee | | |
| 5,772,563 | A * | 6/1998 | Lin | A63B 23/0211 | 482/121 |
| 5,816,985 | A * | 10/1998 | Ho | A63B 21/0004 | 482/125 |
| 6,080,090 | A | 6/2000 | Taylor et al. | | |
| 6,090,023 | A * | 7/2000 | Liu | A63B 21/0004 | 482/130 |
| 6,120,421 | A * | 9/2000 | Kuo | A63B 21/154 | 482/111 |
| 6,220,995 | B1 * | 4/2001 | Chen | A63B 21/02 | 297/175 |
| 6,254,517 | B1 * | 7/2001 | Kennedy | A63B 21/04 | 482/121 |
| 6,368,261 | B1 * | 4/2002 | Doehler | A47C 1/03 | 297/408 |
| 6,565,494 | B1 * | 5/2003 | Chen | A63B 21/0004 | 482/105 |
| 6,592,500 | B1 * | 7/2003 | McBride | A63B 21/0004 | 482/140 |
| 6,743,159 | B1 * | 6/2004 | Taylor | A63B 21/0004 | 482/121 |
| 6,966,871 | B2 * | 11/2005 | Parmater | A63B 21/023 | 482/129 |
| 7,101,328 | B2 * | 9/2006 | Chiu | A63B 21/0004 | 482/140 |
| 7,137,934 | B2 * | 11/2006 | Paramater | A63B 21/068 | 482/123 |
| 7,341,547 | B2 * | 3/2008 | Liao | A63B 21/0004 | 482/140 |
| 7,381,171 | B2 * | 6/2008 | Chen | A63B 21/045 | 482/140 |
| 7,563,211 | B1 * | 7/2009 | Wu | A63B 21/045 | 482/123 |
| 8,002,683 | B1 * | 8/2011 | Nayebdadash | A63B 23/0211 | 482/140 |
| 8,764,617 | B2 * | 7/2014 | Teeter | A61H 1/0292 | 482/126 |
| 8,790,227 | B2 * | 7/2014 | Meister | A63B 23/0494 | 482/140 |
| 8,900,105 | B2 * | 12/2014 | Zhu | A63B 21/0004 | 482/127 |
| 2002/0039953 | A1 * | 4/2002 | Spiel | A63B 21/0552 | 482/92 |
| 2003/0100415 | A1 * | 5/2003 | Augustine | A63B 21/00181 | 482/140 |
| 2004/0209750 | A1 * | 10/2004 | Parmater | A63B 21/068 | 482/123 |
| 2007/0027008 | A1 * | 2/2007 | Levinson | A63B 21/0004 | 482/121 |
| 2007/0135281 | A1 * | 6/2007 | Liao | A63B 21/0004 | 482/140 |
| 2007/0270294 | A1 * | 11/2007 | Sheets | A63B 21/00192 | 482/140 |
| 2007/0281839 | A1 * | 12/2007 | Lin | A63B 21/045 | 482/140 |
| 2007/0281840 | A1 * | 12/2007 | Tsai | A63B 23/0211 | 482/140 |
| 2008/0182730 | A1 * | 7/2008 | Conley | A61H 1/0244 | 482/95 |
| 2010/0022368 | A1 * | 1/2010 | Fernandez | A63B 21/055 | 482/140 |
| 2011/0195826 | A1 * | 8/2011 | Nayebdadash | A63B 23/0227 | 482/140 |
| 2012/0065038 | A1 * | 3/2012 | Nayebdadash | A63B 23/0227 | 482/140 |
| 2012/0184419 | A1 * | 7/2012 | Zhu | A63B 21/0004 | 482/127 |
| 2012/0316041 | A1 * | 12/2012 | Meister | A63B 23/0494 | 482/140 |
| 2013/0072360 | A1 | 3/2013 | Li | | |
| 2013/0095982 | A1 * | 4/2013 | Chen | A63B 21/025 | 482/71 |

FOREIGN PATENT DOCUMENTS

| | | |
|---|---|---|
| CN | 201085873 Y | 7/2008 |
| CN | 203329269 U | 12/2013 |

* cited by examiner

FITNESS APPARATUS

RELATED APPLICATIONS

This application claims priority to Taiwan Application Serial Number 102210791, filed Jun. 7, 2013, and Taiwan Application Serial Number 103206240, filed Apr. 10, 2014, which are herein incorporated by references.

BACKGROUND

1. Technical Field

The present disclosure relates to a fitness apparatus. More particularly, the present disclosure relates to a fitness apparatus employing a solid structure of lever.

2. Description of Related Art

In general, a fitness apparatus with multiple functionalities includes a repeatedly clamping-and-releasing frame to assist doing sit-ups, push-ups, or abdominal workouts, so as to achieve the purpose on single apparatus for providing multiple functionalities for physical exercises.

Conventional clamping-frame fitness apparatus utilizes a torsion spring or a linear elastic element to provide the restoring force. However, the torsion spring usually provides larger restoring force than required, which is not suitable for a user with smaller physical strength. The torsion spring can easily be elastic fatigued and deformed. Moreover, when a user wants to adjust the restoring force of a used torsion spring, the user would need to replace to a new one, and it is never an easy and convenient job. Therefore, conventional clamping-frame fitness apparatus cannot meet varies demands among all users. Furthermore, it is difficult for users to adjust the restoring force of the torsion spring by themselves. The usability of the conventional fitness apparatus is limited owing to difficulties on adjustment.

In addition, when the fitness apparatus uses a linear elastic element to provide the restoring force, a cable is utilized to directly or indirectly drive the linear elastic element. The cable has suitable restoring force. Users can adjust the restoring force of the torsion spring by themselves, so as to achieve the requirement on customization. Unfortunately, the structure of the cable is flexible. When the cable drives the linear elastic element, it needs more guiding component to direct the cable. Moreover, the cable cannot effectively block the displacement or swinging range of the linear elastic element, and it is easy to hit the other components of fitness apparatus due to large bouncing. The problem of collision noise and component wear will reduce the user's comfort, purchase intention and component life of fitness apparatus.

SUMMARY

According to one aspect of the present disclosure, a fitness apparatus includes a first frame, a second frame, a nose part, a linear elastic element, and a lever. The second frame is pivotally connected to the first frame. The nose part is swingly connected to the second frame. The nose part and the second frame are coaxially and pivotally connected to the first frame. The linear elastic element is extendedly bounced on the first frame. The linear elastic element has a first end and a second end. The first end is connected to the first frame. The second end has an accommodating space, and the accommodating space opens a hole outward. The lever has a connecting end, a shaft, and a force-applying end. The hole is configured to block the connecting end in the accommodating space. The shaft is extendedly bounced in the hole, and the force-applying end is pivotally connected to the nose part.

In one example, the connecting end of the lever can be a sphere. The nose part can include a supporting end and a fixed end. The force-applying end can pivotally connect the fixed end, and the supporting end can be configured to abut upon an inner wall of the first frame. The fitness apparatus can include a pulley. The pulley can be pivotally connected to the first frame. The pulley, the second frame and the nose part can be coaxially and pivotally connected to the first frame. Furthermore, the fitness apparatus can include a seat connected to the first frame. The second frame can include a pad. The pad can be configured to abut upon a body of a user.

According to another aspect of the present disclosure, a fitness apparatus includes a first frame, a second frame, a nose part, a linear elastic element, a lever, and an adjusting module. The linear elastic element has a first end and a second end. The second end has an accommodating space. The lever has a connecting end, a shaft, and a force-applying end. The adjusting module has a connecting element, a threaded element, and a screw element. The second frame is pivotally connected to the first frame. The nose part is connected to the second frame as one-piece. The nose part and the second frame are coaxially and pivotally connected to the first frame. The linear elastic element is extendedly bounced on the first frame. The first end is connected to the first frame. The accommodating space opens a hole outward. In addition, the hole is configured to block the connecting end in the accommodating space. The shaft is extendedly bounced in the hole, and the force-applying end pivotally connects the nose part. The first end is movably positioned at the adjusting module. The connecting element connects the first end and one end of the threaded element. Another end of the threaded element connects the screw element. The screw element is positioned at the first frame.

In one example, the connecting end of the lever can be a sphere. The nose part has a supporting end and a fixed end. The force-applying end can pivotally connect the fixed end, and the supporting end can be configured to abut upon an inner wall of the first frame. The fitness apparatus can include a pulley. The pulley can be pivotally connected to the first frame. The pulley, the second frame and the nose part can be coaxially and pivotally connected to the first frame. Furthermore, the fitness apparatus can include a seat connected to the first frame. The second frame can include a pad. The pad can be configured to abut upon a body of a user.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
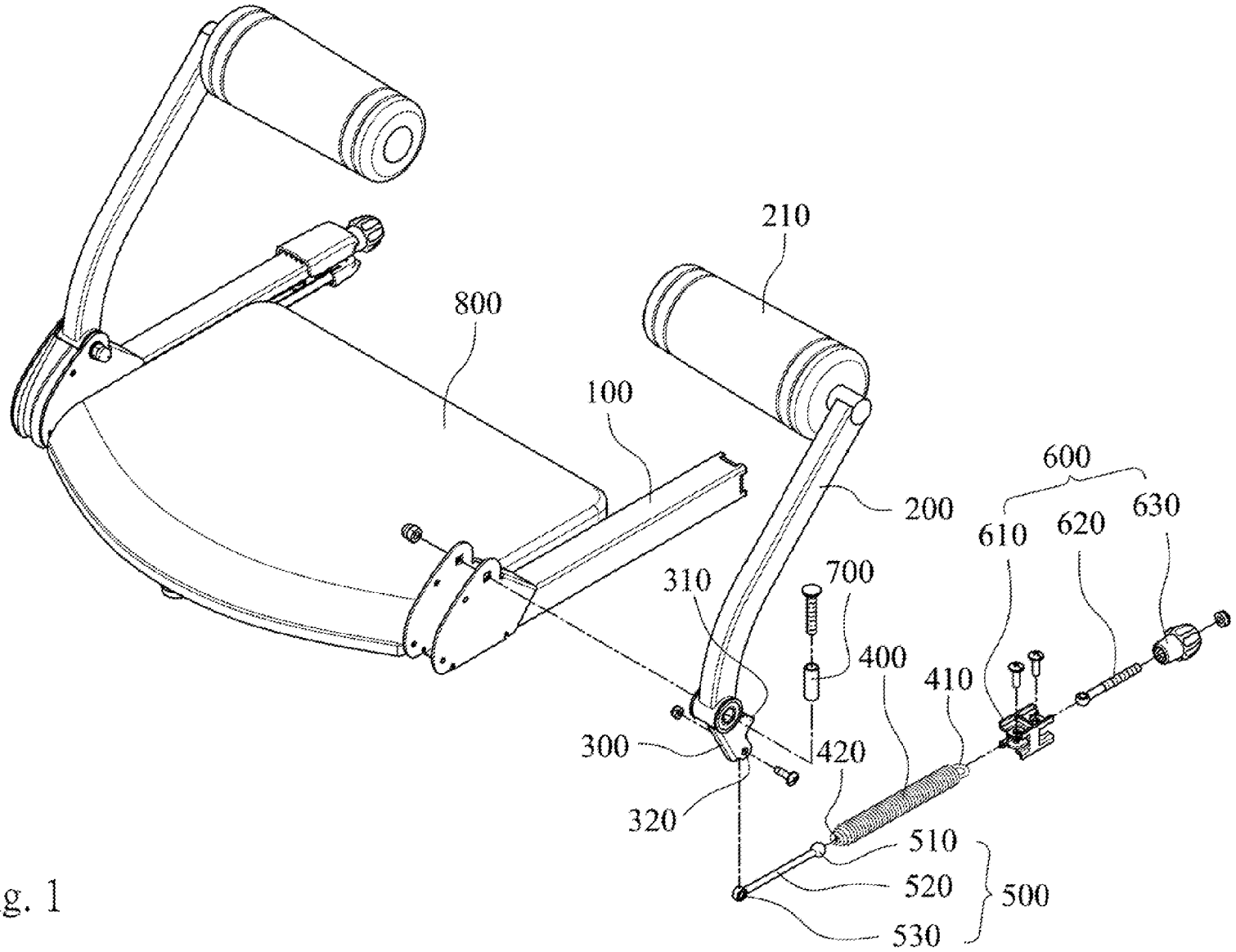
FIG. 1 is an exploded view of a fitness apparatus according to one embodiment of the present disclosure.
Figure 2:
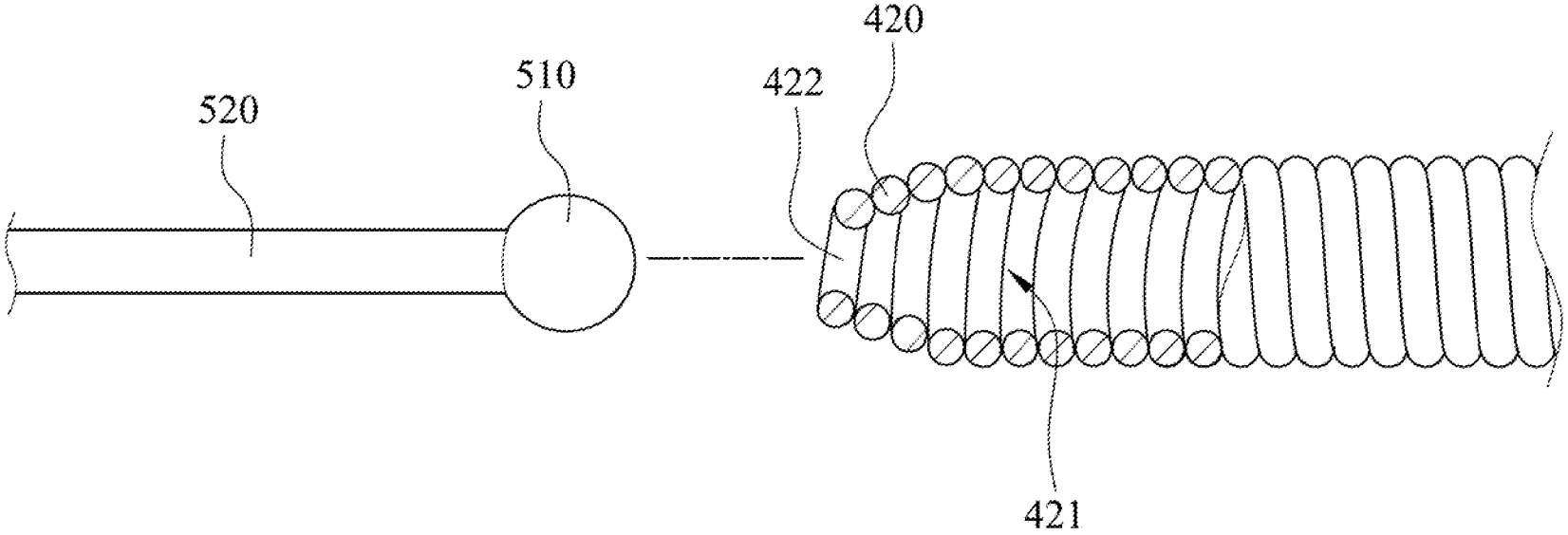
FIG. 2 is a partial cross-sectional view of a lever and a linear elastic element of FIG. 1.
Figure 3:
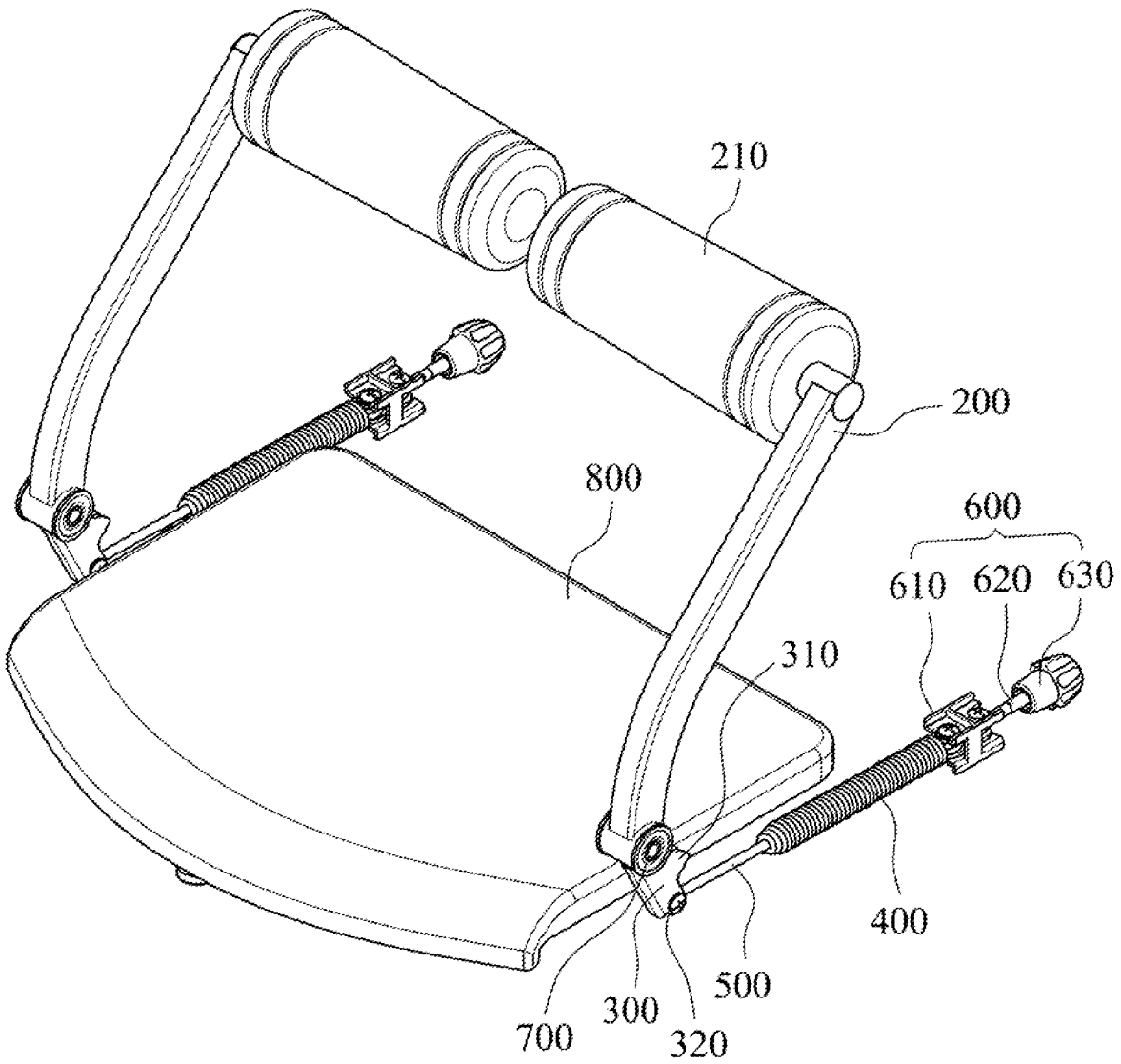
FIG. 3 is a perspective view of partial assembly of the fitness apparatus of FIG. 1.
Figure 4:
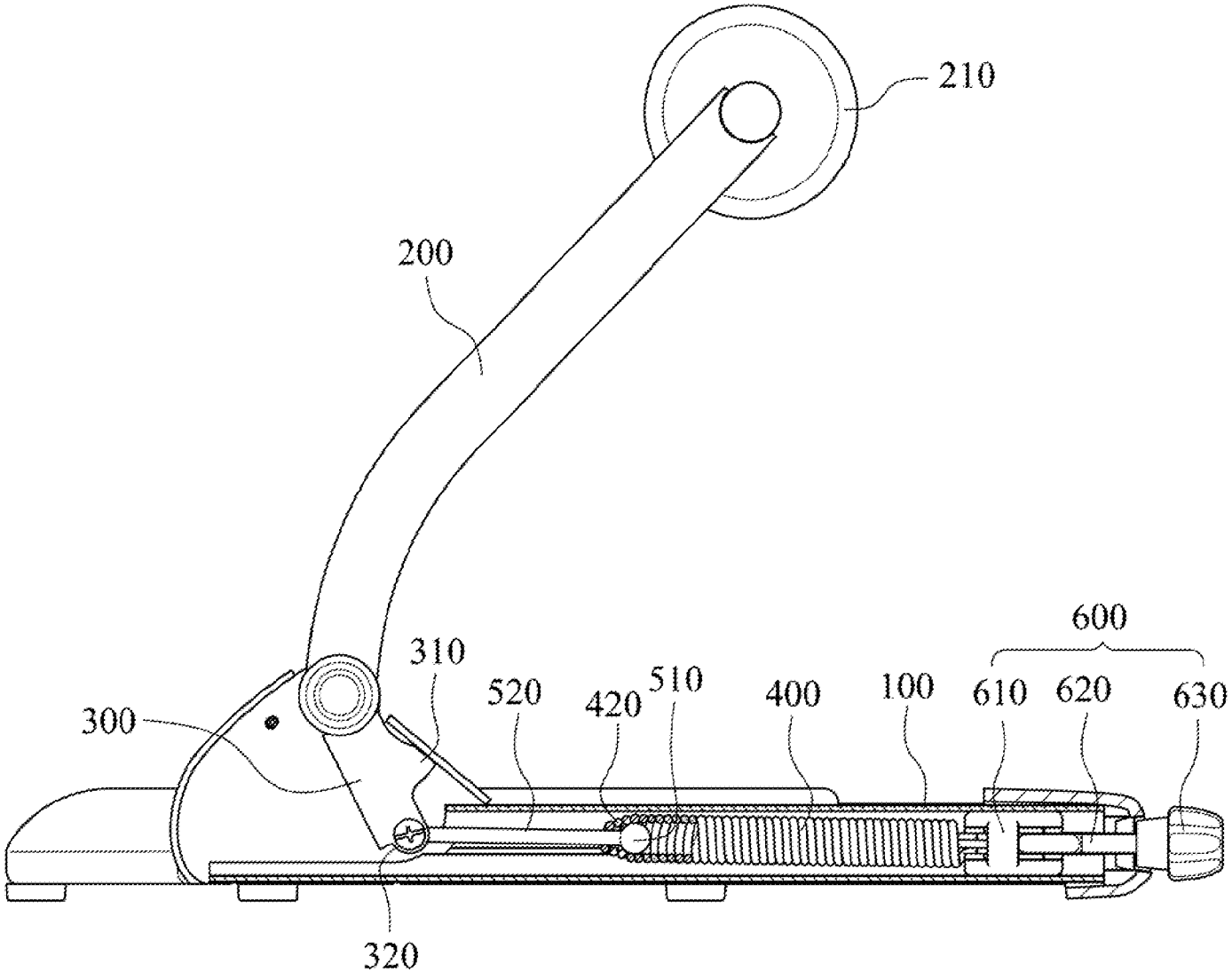
FIG. 4 is a partial cross-sectional view of the fitness apparatus of FIG. 1.
Figure 5:
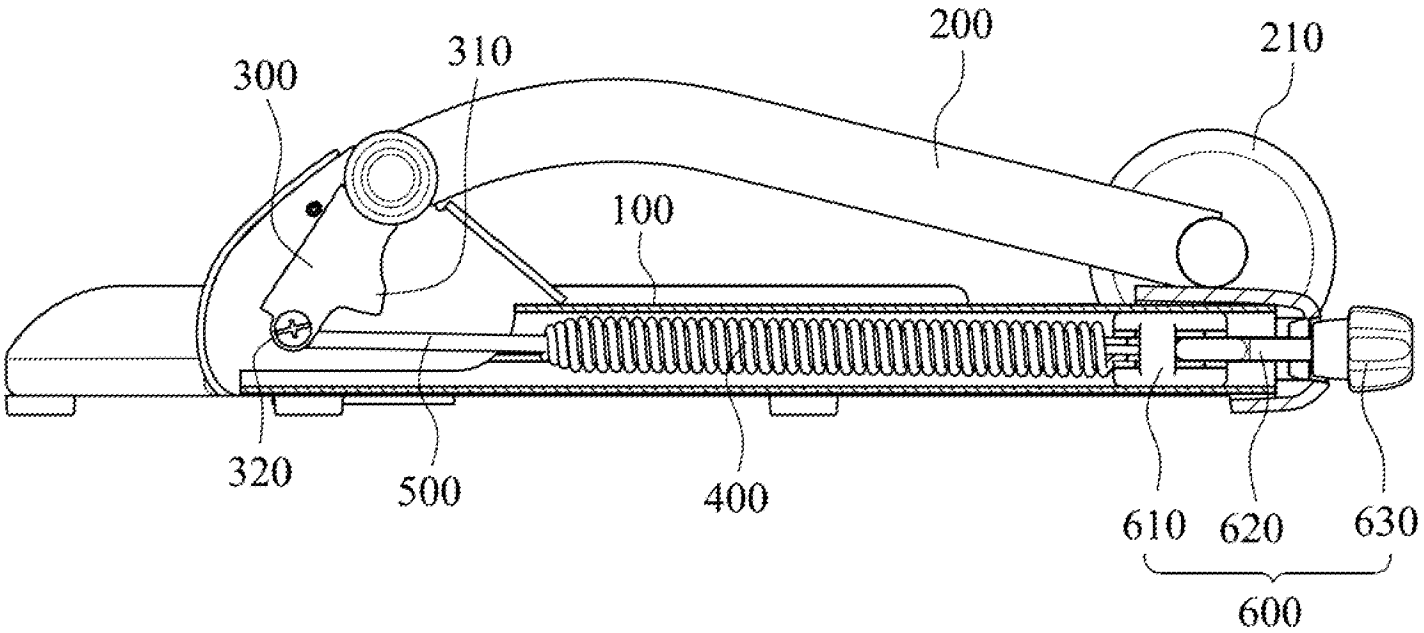
FIG. 5 is a partial cross-sectional view of the fitness apparatus after the second frame winging of FIG. 1.
Figure 6:
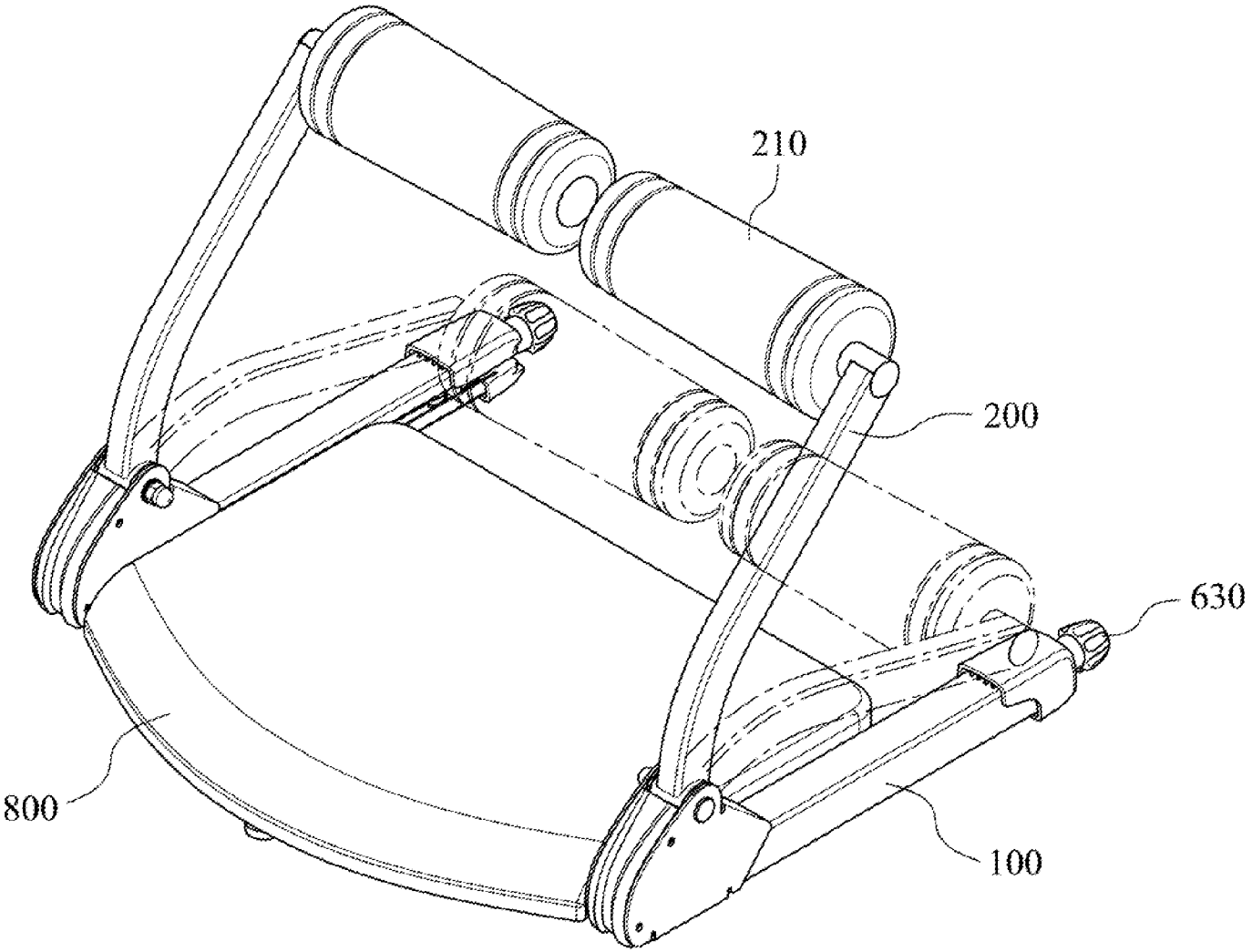
FIG. 6 is a schematic view showing motions of the fitness apparatus of FIG. 1.

FIG. 1 is an exploded view of a fitness apparatus according to one embodiment of the present disclosure. FIG. 2 is a partial cross-sectional view of the lever and linear elastic element of FIG. 1. FIG. 3 is a perspective view of partial assembly of the fitness apparatus of FIG. 1. FIG. 4 is a partial cross-sectional view of the fitness apparatus of FIG. 1. FIG. 5 is a partial cross-sectional view of the fitness apparatus after the second frame swinging of FIG. 1. FIG. 6 is a schematic view showing motions of the fitness apparatus of FIG. 1. These figures illustrate the structure and operation of the following embodiments.

Please refer to FIG. 1, FIG. 2, and FIG. 3. The fitness apparatus includes a first frame 100, a second frame 200, a nose part 300, a linear elastic element 400, a lever 500, an adjusting module 600, a pulley 700 and a seat 800. The nose part 300 has a supporting end 310 and a fixed end 320. The linear elastic element 400 has a first end 410 and a second end 420. The lever 500 has a sphere connecting end 510, a shaft 520 and a force-applying end 530. The adjusting module 600 has a connecting element 610, a threaded element 620 and a screw element 630.

The second frame 200 is pivotally connected to the first frame 100. The nose part 300 is swingly connected to the second frame 200. The nose part 300 and the second frame 200 are coaxially and pivotally connected to the first frame 100. The force-applying end 530 of the lever 500 is pivotally connected to the fixed end 320 of the nose part 300. When the second frame 200 is swinging, the lever 500 driven by the nose part 300 can stretch and shorten the linear elastic element 400. The linear elastic element 400 is extendedly bounced and shifted on the first frame 100. The first end 410 of the linear elastic element 400 connects the first frame 100.

The second end 420 of the linear elastic element 400 has an accommodating space 421. The accommodating space 421 opens a hole 422 outward. The diameter of the hole 422 is smaller than the diameter of the sphere connecting end 510 and larger than the diameter of the shaft 520. Based on this structure, the sphere connecting end 510 can be blocked in the accommodating space 421 of the second end 420. The shaft 520 can be extendedly bounced in the hole 422.

Please refer to FIG. 1 and FIG. 4. Before the second frame 200 swinging, the linear elastic element 400 pulls the lever 500 by its restoring force. The lever 500 drives the fixed end 320 of the nose part 300. The supporting end 310 of the nose part 300 is configured to abut upon the inner wall of the first frame 100. At the same time, the second frame 200 is stable because the nose part 300 and the second frame 200 are coaxially and pivotally connected to the first frame 100. Normally, a pad 210 can be installed to the second frame 200 in order to rest user's back or body. Owing the second frame 200 is stable, the weight of the pad 210 or the weight of the second frame 200 will not lead to the second frame 200 swinging or falling down.

Please refer to FIG. 1 and FIG. 5. After the second frame 200 swinging by an outside force, the supporting end 310 of the nose part 300 and the inner wall of the first frame 100 will be separated. The fixed end 320 of the nose part 300 drives the force-applying end 530 of the lever 500. The sphere connecting end 510 closely connects the second end 420 and elongates the linear elastic element 400. If the outside force deviates from the second frame 200, the second frame 200 will return to the original state ahead, as shown in FIG. 4. Additionally, the second frame 200 can be integratedly connected to the nose part 300 as one-piece.

The first end 410 of the linear elastic element 400 is movably positioned at the adjusting module 600. The connecting element 610 connects the first end 410 and one end of the threaded element 620. Another end of the threaded element 620 connects the screw element 630. Because the screw element 630 is positioned at the first frame 100, the displacement of the threaded element 620 can adjust the position of the connecting element 610 at the first frame 100 by rotating the screw element 630. If the position of the connecting element 610 is moved near to the screw element 630, the first end 410 is moved near to the screw element 630. The restoring force of the linear elastic element 400 is increased due to the spread of the linear elastic element 400. Conversely, when the position of the connecting element 610 is moved distant from the screw element 630, the first end 410 is moved near to the nose part 300, and the restoring force of the linear elastic element 400 is decreased.

The pulley 700, the second frame 200 and the nose part 300 can be coaxially and pivotally connected to the first frame 100. The second frame 200 and the nose part 300 can swing relative to the first frame 100 through the assistance of the pulley 700. Furthermore, the seat 800 can be connected to the first frame 100, and the second frame 200 can include the pad 210. The seat 800 and the pad 210 are used for resting users back or body. The seat 800 and the pad 210 can be foam or buffer materials.

The second frame 200 can swing to be close with the first frame 100, and then by the restoring force of the linear elastic element 400, the second frame 200 can swing back to the original position again, as described in FIG. 6. A user can sit on the seat 800, and rest his/her back on the pad 210, so that the fitness apparatus can assist sit-up exercises. A user can also lie prone on the fitness apparatus with his/her chest resting against the pad 210 and hands on the ground, so that the fitness apparatus can assist push-up exercises. Moreover, a user can also rest each foot on each of the two pads 210, so that the user can step down left foot and right foot alternatively or at the same time to make the second frame 200 swinging against the first frame 100, thus the fitness apparatus can assist the stepping exercise, or simulating the cycling strokes. A user can further lie on the side over the fitness apparatus to exercise, grasp the first frame 100 or the second frame 200 to exercise arms, or lift legs using the fitness apparatus. In such versatile manners, the fitness apparatus can assist many kinds of exercises and is not limited by the exampled above.

According to the aforementioned embodiments and examples, the advantages of the present disclosure are described as follows.

Adopting the lever to quickly constrain the displacement and movable range of the linear elastic element owing to the high stiffness of the lever. The linear elastic element can be stably stretched and shortened by the lever.

Using the lever to prevent the linear elastic element from hitting the inner wall of the first frame. The linear elastic element can be stably bounced without sounds caused by hitting and attrition. The structure is noiseless and can increase the life time of the components thereof.

Although the present disclosure has been described in considerable detail with reference to certain embodiments thereof, other embodiments are possible, Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fitness apparatus, comprising:

a first frame;

a second frame pivotally connected to the first frame;

a nose part rotatably connected to the second frame, wherein the nose part and the second frame are coaxially and pivotally connected to the first frame, a linear elastic element configured to vary in position on the first frame in response to applied compression and tension forces, wherein the linear elastic element has a first end and a second end, the first end is connected to the first frame the second end has an accommodating space, the accommodating space is configured to have a hole opening outward through the second end; and a lever having a connecting end, a shaft and a force-applying end, wherein the hole is configured to block the connecting end in the accommodating space, the shaft is configured to vary in position in the hole in response to applied forces, and the force-applying end is pivotally connected to the nose part;

wherein the connecting end of the lever is a sphere.

2. The fitness apparatus of claim 1, wherein the nose part comprises a supporting end and a fixed end, the force-applying end pivotally connects to the fixed end, and the supporting end is configured to abut upon an inner wall of the first frame.

3. The fitness apparatus of claim 1, further comprising:

a pulley pivotally connected to the first frame, wherein the pulley, the second frame and the nose part are coaxially and pivotally connected to the first frame.

4. The fitness apparatus of claim 1, further comprising:

a seat connected to the first frame.

5. The fitness apparatus of claim 1, wherein the second frame comprises a pad configured to abut upon a body of a user.

6. A fitness apparatus, comprising:

a first frame;

a second frame pivotally connected to the first frame;

a nose part integratedly connected to the second frame as one-piece, wherein the nose part and the second frame are coaxially and pivotally connected to the first frame;

a linear elastic element configured to vary in position on the first frame in response to applied compression and tension forces, wherein the linear elastic element has a first end and a second end, the first end is connected to the first frame, the second end has an accommodating space, and the accommodating space is configured to have a hole opening outward through the second end;

a lever having a connecting end, a shaft and a force-applying end, wherein the hole is configured to block the connecting end in the accommodating space, the shaft configured to vary in position in the hole in response to applied forces, and the force-applying end pivotally connects to the nose part; and an adjusting module comprising a connecting element, a threaded element, and a screw element, wherein the first end is movably positioned at the adjusting module, the connecting element connects the first end and one end of the threaded element, another end of the threaded element connects to the screw element, and the screw element is positioned at the first frame;

wherein the connecting end of the lever is a sphere.

7. The fitness apparatus of claim 6, wherein the nose part comprises a supporting end and a fixed end, the force-applying end pivotally connects to the fixed end, and the supporting end is configured to abut upon an inner wall of the first frame.

8. The fitness apparatus of claim 6, further comprising:

a pulley pivotally connected to the first frame, wherein the pulley, the second frame and the nose part are coaxially and pivotally connected to the first frame.

9. The fitness apparatus of claim 6, further comprising:

a seat connected to the first frame.

10. The fitness apparatus of claim 6, wherein the second frame comprises a pad configured to abut upon a body of user.

* * * * *